United States Patent [19]

Bakke

[11] Patent Number: 4,802,535

[45] Date of Patent: Feb. 7, 1989

[54] FIRE-FIGHTING TOOL

[76] Inventor: Arlan N. Bakke, Rte. 1, Cushing, Minn. 56443

[21] Appl. No.: 7,182

[22] Filed: Jan. 27, 1987

[51] Int. Cl.[4] ..... A62C 31/22

[52] U.S. Cl. ..... 169/70; 169/54; 239/271; 239/559; 239/567

[58] Field of Search ..... 169/70, 54; 239/271, 239/556, 557, 559, 567

[56] References Cited

U.S. PATENT DOCUMENTS

| | | | |
|---|---|---|---|
| 392,844 | 11/1888 | Best . | |
| 551,527 | 12/1885 | Cunningham . | |
| 674,343 | 5/1901 | Oakes . | |
| 822,546 | 6/1906 | Newman | 239/559 X |
| 916,886 | 3/1909 | Merryman . | |
| 2,224,010 | 12/1940 | Barber . | |
| 2,334,395 | 11/1943 | Dowell et al. | 239/271 |
| 2,813,753 | 11/1957 | Roberts . | |
| 2,993,650 | 7/1961 | Badberg | 239/271 |
| 4,124,077 | 11/1978 | Barge | 169/70 |
| 4,219,084 | 8/1980 | Gray et al. | 169/70 |
| 4,676,319 | 6/1987 | Cuthbertson | 169/70 |
| 4,697,740 | 10/1987 | Ivy | 169/70 X |

FOREIGN PATENT DOCUMENTS

| | | | |
|---|---|---|---|
| 177517 | 1/1906 | Fed. Rep. of Germany | 239/559 |
| 1258434 | 9/1986 | U.S.S.R. | 169/70 |

*Primary Examiner*—Joseph F. Peters, Jr.
*Assistant Examiner*—James M. Kannofsky
*Attorney, Agent, or Firm*—Schroeder & Siegfried

[57] ABSTRACT

A fire-fighting tool having a perforated pointed forward end is designed to automatically maintain its water-emitting portions in place within the interior of a burning building, without manual attention thereto, after the wall or roof of such a building have been pierced with same. Rearwardly directed ports are carefully arranged so as to produce non-intersecting streams of water. These ports emit water under high pressure when the pointed heavy tool is attached to a fire hose and serve to extinguish the fire at the inner surface of the outside wall, and at the same time prevent the tool from being ejected rearwardly, which would be the normal result of the passage of water under high pressure from the fire hose through such a tool. A cement block or frame wall can be pierced with the tool while manned by a single fire-fighter, who may retreat from danger while the tool, because of its construction, remains in place to effectively extinguish the fire, because the rearward urging normally experienced by such a tool has been completely eliminated.

20 Claims, 2 Drawing Sheets

FIRE-FIGHTING TOOL

DESCRIPTION

BACKGROUND OF THE PRIOR ART

Fire-fighting is an art which has experienced serious difficulties because of the inherent dangers and the limitations imposed by the fire sought to be extinguished. Because of the intense heat involved, it is frequently almost impossible to gain sufficient access to the fire to enable the fire-fighters to effectively combat same. Thus, for example, fires are frequently contained within a room or building while burning intensely, with the net result that great damage occurs before access to the fire is obtained, whereas such damage can be greatly reduced if access is readily obtainable. Moreover, serious physical harm often comes to fire-fighters as they seek to obtain such access, as by cutting holes in the roof or walls of the building. In addition, once access is obtained, the fire frequently commences to burn more intensely, at least until such time as an adequate water supply can be brought into play. Also, the intensity of such fire and the dangers associated therewith frequently drive the firemen back, away from the proximity needed to effectively combat it. My fire-fighting tool is constructed and arranged to overcome these obstacles and problems.

Much of the attention of the prior art has been directed toward producing a more effective conditioning of the water supply used in fighting the fire, such as the production of a water fog, as it is called. This type of device converts the stream of water under pressure into a fine mist or spray which has proven more effective than a solid stream of water emitted from a fire hose. U.S. Pat. No. 2,993,650 illustrates such a device which is designed to be driven through a wall and to produce intersecting streams of water, which in turn produce a fog pattern within the interior of the building of which the wall is a part. The effectiveness of such a device is confined to a limited area.

U.S. Pat. No. 4,219,084 shows a similar device designed to be driven through the fuselage of an aircraft to introduce a water spray into its interior.

U.S. Pat. No. 1,548,621 likewise utilizes a penetrating nozzle, which is driven with a sledge hammer. U.S. Pat. No. 551,527 also shows a pointed nozzle designed to be forced through a floor with provision being made to prevent flames and smoke from escaping around the periphery of the tool from the room below.

U.S. Pat. No. 674,343 also shows a pointed perforated nozzle which can be used to gain entrance into the interior of the room. U.S. Pat. No. 2,812,753 also shows a pointed nozzle designed to pierce the wall of a room. U.S. Pat. No. 1,224,010 shows a pointed nozzle for the same purpose.

None of the above patents, however, address the problems experienced by firemen while using these devices, which are that they are driven away from the exterior of the pierced wall, roof or floor by the heat and by the inherent danger of collapse of such a wall, roof or floor. If such devices are left unattended, the inherent pressure, transmitted through the nozzles by the pressurized water emitting therethrough, causes the nozzle to be ejected rearwardly, and to thrash around, much like the free end of a garden hose when water under substantial pressure is transmitted therethrough. Such devices must be attended manually, thereby necessarily submitting the attending fire-fighters to intense heat and danger. If left unattended, they will quickly eject rearwardly with a complete lack of helpful consequences. Also, most such devices require at least several fire-fighters to effectively man the same.

My novel fire-fighting tool can be utilized by a single fireman and can be left unattended once the wall, floor or roof has been pierced thereby, while the water continues to be sprayed in all directions within the interior of the building to quickly control and extinguish the flames within that portion of the building. It is normally effective throughout the entire interior area into which its pointed perforated end extends.

BRIEF SUMMARY OF THE INVENTION

My invention is comprised of an elongated tool which has a hardened conical point at one end and a hollow interior. Preferably, it is made of hardened steel pipe. The rear end portion of the tool is solid, of heavy ballast and is provided with handles, as is the forward end portion. The handles on the forward end portion are located just rearwardly of a connector coupling which is adapted to connect the hollow interior with a charged fire hose. The forward and hollow end portion of the pipe is frusto-conically shaped, is perforated and threadably carries a solid sharpened point, as a continuation thereof, at its forward end.

The perforated frusto-conical portion of the tool provides the means whereby the tool will be automatically retained in piercing relation to the wall and by which the fire will be quickly extinguished. Toward that end, the more forwardly disposed openings or perforations are directed forwardly and the more rearwardly disposed openings are directed rearwardly, while those which are more intermediately disposed are directed radially. Each of the openings is positioned and directed so as to avoid intersection of the water streams which emanates therefrom when the tool is pressurized through attachment to a charged fire hose. The rearwardly directed openings, each arranged so as to preclude intersection of its emitted stream with those of other openings or with each other, function in combination with the other openings to maintain the tool at location, contrary to what would be normally expected from such a device. I have found that a single fire-fighter can pierce a cement block wall with the tool, retreat from the danger area adjacent same, and then turn on the fire hose, with the highly desirable result that the tool will remain in position unattended, in piercing relation to the wall, and while unattended, will effectively spray the interior of the building in all directions for a substantial distance, as hereinafter described.

It is an object of my invention to produce a new fire-fighting tool which will greatly reduce the danger to firemen in fighting fires within the interior of buildings and at the same time enhance their fire-fighting activities by enabling them to more effectively and more quickly extinguish such a fire.

A more specific object is to furnish a new fire-fighting tool which will provide ready access for a fireman to the interior of a building and will enable him to retreat to a safe distance from the building while the tool remains in place by itself, unattended and while large volumes of pressurized water are disseminated therethrough in all directions, to thereby extinguish the fire in record time.

A still more specific object is to eliminate completely all urging and tendency for such a fire tool to eject rearwardly after it has penetrated a wall and thereby to permit such a tool to be unattended while the fireman retreats to a safe distance.

BRIEF DESCRIPTION OF THE DRAWINGS

A detailed description of one preferred embodiment of the FIRE-FIGHTING TOOL is hereafter described with specific reference being made to the drawings in which:

FIG. 1 shows a pair of firemen grasping one of my fire-fighting tools indicated generally by the numeral 10 by the handles of the tool and thrusting the point thereof against the wall for the purpose of impacting the same, thereby to cause the pointed end thereof to pierce the wall and extend therethrough. As shown, the tool is connected to a fire hose 11 which has not yet been charged with water under pressure. As indicated previously herein, the tool is capable of being handled, if necessary, by a single fireman in that it weighs only approximately 40–45 pounds.

FIG. 2 is a bottom plan view of the preferred embodiment of my invention. As shown, it includes an elongated, hollow steel pipe 12 having a forward end portion 13 which is frusto-conical in shape and a rearward end portion 14. The frusto-conical forward end portion 13 is perforated with a plurality of openings 15 arranged in circles around the circumference of the entire frusto-conical portion. As shown, they are disposed throughout the length of the frusto-conical portion 13 and bring the interior of the hollow pipe 12 into fluid communication with the exterior. The forward end portion 13 carries at its forward most point a heat-treated steel point 16 which is threadably mounted within the open smaller end of the frusto-conical portion 13, as best shown in FIGS. 4 and 5. This point 16 is heat-treated for hardness.

Figure 6:
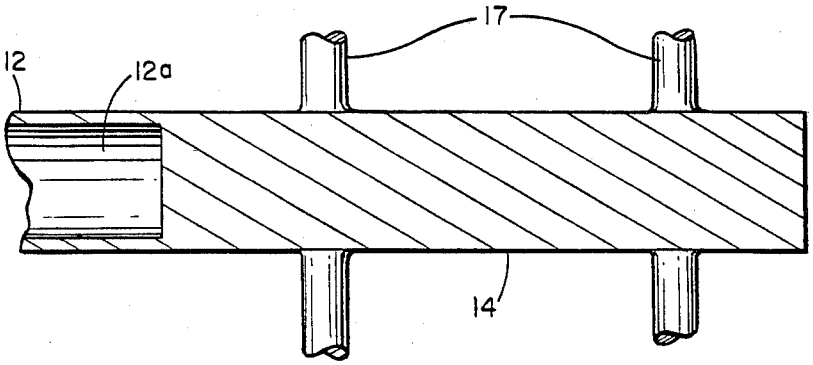
FIG. 6 is a fragmentary sectional view taken along line 6—6 of FIG. 3.

As best shown in FIG. 6, the pipe 12 is hollow throughout the major portion of its length. The rearward portion thereof, however, is solid, as best shown in FIG. 6, the hollow portion 12*a* terminating just short of the rearwardly disposed handles 17. The solid portion at the rear is provided to add ballast to the tool so that when the tool is thrust rapidly at the wall, indicated by the numeral 18, the sharp point 16 will pierce the same with the result that the frusto-conical portion 13 will be disposed inwardly of the inner surface of the wall. The handles 17 are rectangularly shaped, as shown, as are the forwardly disposed handles 19.

Mounted on the forward end portion of the pipe 12 and secured inwardly therewith, as by welding, is a connector coupling 20. It is formed of a piece of steel tubing and has an outwardly threaded free end portion 21, which is adapted to be connected to a fire hose 11. The connector coupling 20 is hollow and communicates with the hollow interior of the pipe 12, in order to provide the necessary charge of pressurized water to the perforated end portion 13 after the wall has been pierced with the tool. The hose 11, of course, is connected either to a water main or to a fire truck to provide water under the desired pressure ranges. It will be noted that the longitudinal axis of the coupling 20 extends at an angle of 30° to the longitudinal axis of the pipe 12.

Figure 1:
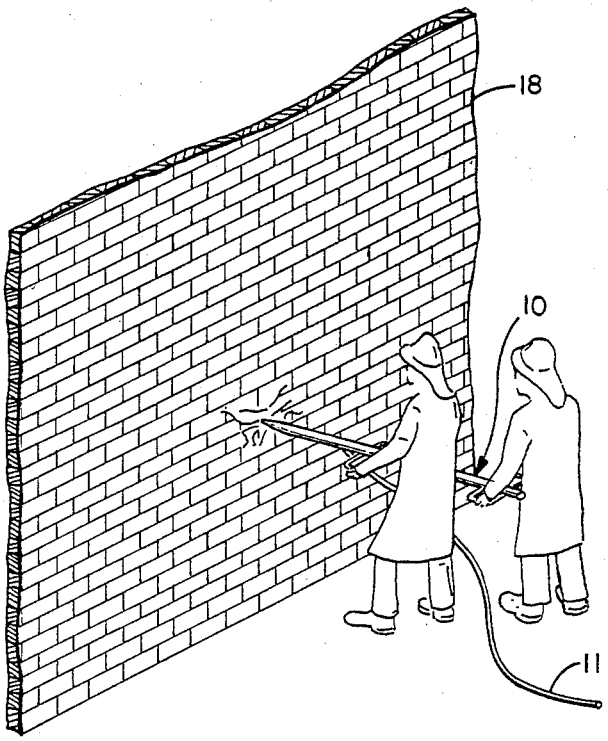
FIG. 1 is a perspective view of a pair of firemen preparing to pierce the wall of a building with my novel fire-fighting tool in hand.
Figure 2:
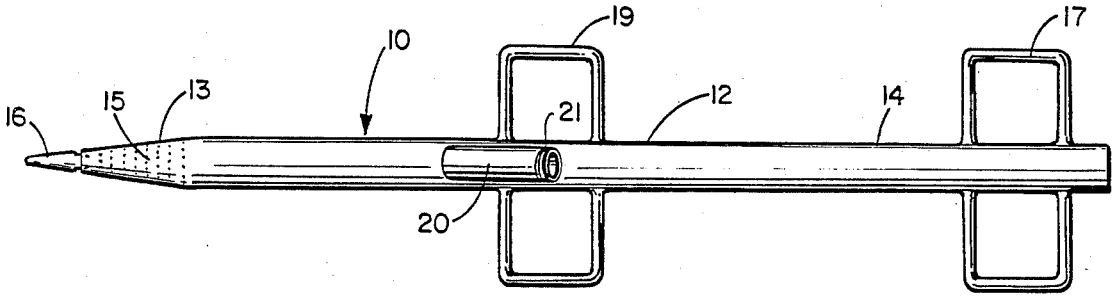
FIG. 2 is a bottom plan view of my fire-fighting tool.
Figure 3:
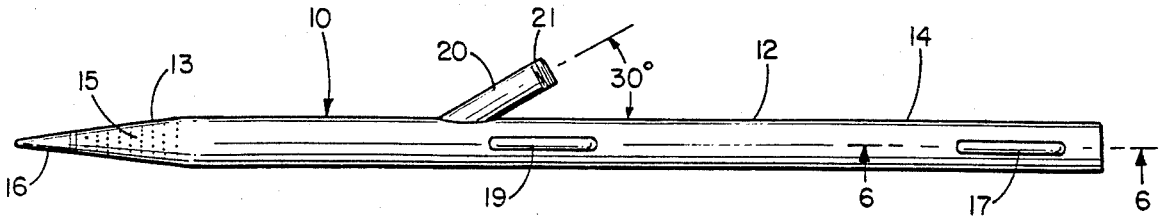
FIG. 3 is a side elevational view thereof.
Figure 4:
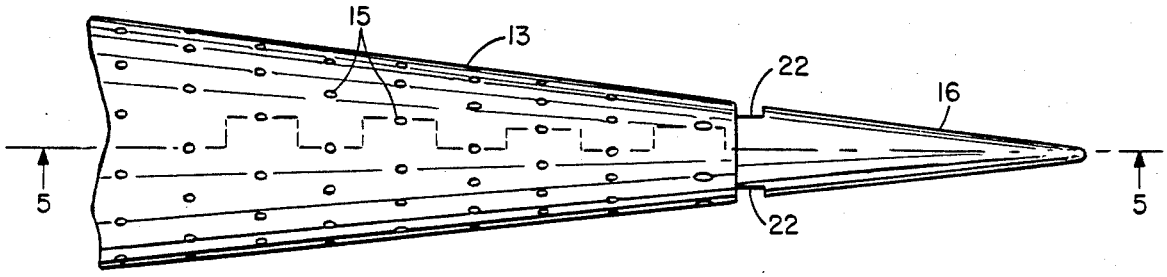
FIG. 4 is a fragmentary side elevational view of the forward end portion of my above tool.

FIG. 4 shows the point 16 inside elevation with two opposed sides thereof relieved as at 22 to facilitate tightening or loosening of the point with a wrench, as desired. As a consequence, the hardened point 16 may be replaced in the event it is broken while piercing concrete or stone walls.

Figure 5:
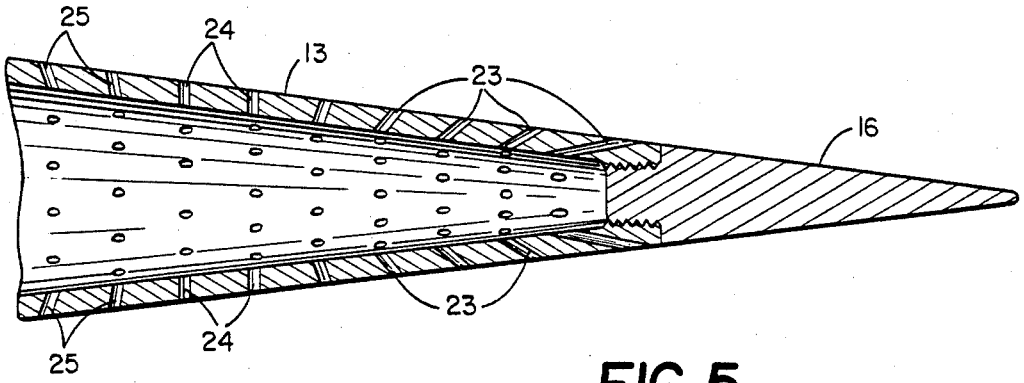
FIG. 5 is a vertical sectional view taken along line 5—5 of FIG. 4.

FIG. 5 shows a vertical sectional view of the forward end portion 13, taken along line 5—5 of FIG. 4. As shown, the wall of the forward end portion 13 is uniform in thickness and is approximately ¼" thick.

FIG. 5 shows the openings 15 as they are arranged and oriented. They are arranged along axially spaced circumferential lines and are spaced within each such line equally. As shown, the openings 15 formed in the most forward area of the forward end portion 13 are directed forwardly and outwardly. These forwardly and outwardly directed openings are identified by the numeral 23. As shown, these forwardly directed openings comprise the front five rows of openings. The most forward row of openings 23 are arranged to extend approximately 10° off the axis of the pipe 12, while the second row extends at approximately 30° off that axis. The third row extends at 40° off the axis of the pipe 12, the fourth row extends at 50° and the most rearward row extends at approximately 70° off the axis of the pipe 12.

As shown, two of the intermediate rows of openings identified by the numeral 24 extend at 90° to the axis of the pipe 12, while the remaining two more rearwardly disposed rows are arranged to extend rearwardly relative to that axis. These rearwardly extending openings, which are approximately 48 in number and approximately ⅛ inch in diameter each, have been identified by the numeral 25. The most rearward of these two openings 25 extend at an angle of about 70° to the axis of the pipe 12, while the innermore row extend at approximately 80° to that axis.

As stated previously, all of the openings 23, 24 and 25 are arranged so that the streams of water emanating therefrom will not intersect the stream of any other opening. It appears from our tests that the rearwardly directed openings 25, arranged in such non-intersection relation, completely eliminate any tendency for the tool to be ejected rearwardly, which would be present without the use of such rearwardly directed openings.

The pipe 12 weighs approximately 40–45 pounds, is about 5 ft. in length, and the perforated area has an axial length of about 5¼". The hardened point 16 is 3½" in length.

It is possible for a single fireman to pick up the tool 10 with a fire hose attached thereto and pierce the wall of the building with the piercing point 16 to thereby cause the perforated portion 13 to extend inwardly beyond the inner surface of a burning wall, such as the wall 18. Thus, the tool will be inserted by ramming the pointed end thereof against the wall, with the wall extending thereafter between the perforated frusto-conical portion 13 of the tool and the connector coupling 20. The connector coupling 20 acts as a protective element for the hands of the fireman grasping the forward handles 19. Of course, this can be accomplished more easily by two firemen and for that reason, I have provided the tool with two handles for use as shown.

Once the wall has been pierced, as described above, the tool may be left in position and the firemen may retreat therefrom to a safe location and can make the water supply under pressure available to the tool, thereby charging the same. Streams of water will then emanate through each of the openings 23, 24 and 25, which will be disposed inwardly of the inner surface of the wall. The openings 25 in the two most rearward rows of openings will direct their streams rearwardly in all directions. The latter streams will engage the inner surface of the exterior wall which may be burning as fiercely as any other portion of the room. As a result of striking the inner surface of the outer pierced wall, the tool is urged inwardly sufficiently to maintain same in a piercing relation to the wall, despite the fact that it is unattended.

Upon opening of the valve upon the fire truck or otherwise charging the fire hose, a stream of water will be emitted from each of the openings 23, 24 and 25 in non-intersecting relation. I have found that at a pressure of 150 p.s.i., water will be sprayed by the tool over an area of 2400 sq. ft. and when held at a height of 10 ft., a circle of 54 ft. in diameter will be covered. Our tests show that upon the tool being charged when extending through such a wall, a severely burning fire in the interior will be extinguished in 10–20 seconds. At a pressure of 100 p.s.i., I find that 176 gallons per minute will be discharged through the perforated frusto-conical portion 13. At a pressure of 150 p.s.i., 212 gallons per minute are sprayed throughout the interior of such an area inwardly of the inner surface of the pierced wall.

Normally, when a fire hose is initially charged, as described above, a very pronounced rearward jerk is experienced at the discharge end of the hose or at such a tool. I have found that such a rearward jerk is not experienced with this tool, possibly because of the existence of the air cavity which exists within the pipe rearwardly of the point of entrance of water to the connector coupling 20. In any event, the tool will remain in piercing relation to the wall, despite the fact that it is being so charged while unattended.

From the above, it can be seen that I have provided an improved fire-fighting tool which readily enhances the fire-fighting abilities of firemen and at the same time, substantially reduces the inherent danger from falling walls or roofs, or possibly interior explosions of oil tanks or other potentially explosive materials. Through the use of this fire-fighting tool, such dangers are almost completely eliminated while the intensive fire behind the wall may be quickly extinguished. Experienced firemen who have tested this tool are enthusiastic in their endorsement of its performance and use in fire-fighting activities. Test runs have shown that this tool is highly effective in accomplishing the quick extinguishing of intensive fires behind walls of buildings, or beneath roofs or in basements beneath floors. Each of the latter can be pierced with this tool and utilized effectively, while the firemen may observe this operation from a relatively remote and safe distance.

In considering this invention, it should be remembered that the present disclosure is illustrative only and the scope of the invention should be determined by the appended claims.

What is claimed is:

1. A portable fire-fighting tool, comprising:

(a) an elongated section of steel pipe having forward and rearward end portions and having a hollow interior and a hollow generally conically-shaped forward end portion in fluid communication with said interior;

(b) a pointed, steel, piercing element carried by said forward end portion and extending forwardly therefrom, said piercing element being constructed and arranged to pierce the wall or roof of a burning building when rammed forcefully thereagainst to thereby extend, with said forward end portion, into the interior of such a building;

(c) said hollow forward end portion having wall structure with a plurality of openings extending therethrough and bringing the interior thereof into fluid communication with the interior of such a building when the wall or roof of the latter is so pierced by said piercing element and said forward end portion of said pipe;

(d) a tubular connector coupling mounted on intermediate portions of said pipe and connected in fluid communication with the hollow interior of said pipe, said connector coupling being constructed and arranged to be connected in fluid communication with a fire hose to receive water under pressure therefrom; and said openings of said hollow end portion being constructed and arranged to maintain said forward end portion within the interior of such a building in wall-piercing position after it has pierced such a wall and extended into the interior of such a building, whereby a fire within the interior of the building will be quickly extinguished by a spray of water emanated from said openings of said hollow end portion when pressurized water is admitted into the fire hose, and toward that end;

(f) some of said openings being directed rearwardly and arranged to produce streams of water emanating therethrough in non-intersecting relation to streams of water emanating from all other of said openings in said wall structure.

2. The structure defined in claim 1 wherein some of said openings are directed forwardly and some are directed rearwardly, said rearwardly directed openings being sufficient in number and size to counteract and nullify the rearwardly directed effect upon said pipe section of the water emanating from said forwardly directed openings and thereby maintaining said forward end portion and said piercing element in wall-piercing position as water under pressure is received within said forward end portion and disseminated through said openings into the interior of such a building.

3. The structure defined in claim 1, and handle members carried by said pipe section adjacent each of its said forward and rearward end portions and extending outwardly therefrom.

4. The structure defined in claim 1 wherein said openings of said hollow end portion include a plurality of radially directed openings and a plurality of rearwardly directed openings disposed rearwardly of said radially directed openings.

5. The structure defined in claim 1 wherein said openings of said hollow forward end portion include a plurality of forwardly directed openings adjacent said piercing element and a plurality of radially directed openings adjacent to and disposed rearwardly of said forwardly directed openings and a plurality of rearwardly directed openings adjacent to and disposed rearwardly of said radially directed openings.

6. The structure defined in claim 5 wherein said rearwardly directed openings are disposed rearwardly of all other of said openings in said hollow forward end portion.

7. The structure defined in claim 1 wherein said connector coupling is in fluid communication with the hollow interior of said point at a point adjacent and behind said rearwardly directed openings and the axis of said connector coupling extends at an acute angle to the horizontal axis of the hollow interior of said pipe member.

8. The structure defined in claim 1; and (g) a handle member carried by said pipe and extending outwardly therefrom adjacent to but behind said connecting coupler, whereby the latter functions as a protection element for the fireman's hand as he grasps said handle member.

9. The structure defined in claim 1 wherein said openings of said hollow forward end portion are arranged along a series of axially spaced circumferential lines, the forwardmost disposed of said openings being directed forwardly and the most rearwardly disposed of said openings being directed rearwardly, each of said openings being directed and arranged to produce streams of water emanating therefrom in non-intersecting relation to streams of water emanating from all other openings in said wall structure.

10. The structure defined in claim 1 wherein said piercing element is solid and is threadably mounted in the forwardmost portion of said forward end portion.

11. The structure defined in claim 1 wherein said forward end portion is frusto-conical in shape and has a hollow core and said piercing element is threadably mounted in the forward end of the core of said forward end portion.

12. The structure defined in claim 1 wherein said pipe has hollow portions disposed rearwardly of said connector coupling.

13. The structure defined in claim 1 wherein said pipe has closed rear end portions which are solid throughout and provide ballast to facilitate the piercing of a roof or wall with said piercing element.

14. The structure defined in claim 1 wherein said rearwardly directed openings have an axis extending at approximately seventy (70°) degrees to the longitudinal axis of said pipe.

15. The structure defined in claim 1 wherein said rearwardly directed openings are arranged along axially spaced circumferential lines and approximate 48 in number along each of said lines.

16. The structure defined in claim 1 wherein each of said openings have a diameter approximating ⅛ inch.

17. The structure defined in claim 1 wherein said tubular coupling connector has an axis extending at approximately thirty (30°) degrees relative to the longitudinal axis of said pipe.

18. The structure defined in claim 1 wherein said openings of said hollow forward end portion include a plurality of forwardly directed openings adjacent said piercing element and a plurality of radially directed openings adjacent to and disposed rearwardly of said forwardly directed openings and a plurality of rearwardly directed openings adjacent to and disposed rearwardly of said radially directed openings, all of said openings being arranged along equally axially spaced circumferential lines and being equally spaced circumferentially within each of said lines.

19. A portable fire-fighting tool comprising:

(a) an elongated section of steel pipe having a hollow interior and a hollow frusto-conically-shaped forward end portion in fluid communication therewith;

(b) a pointed steel piercing element carried by said forward end portion and extending forwardly therefrom, said piercing element being constructed and arranged to pierce the wall or roof of a burning building when rammed forcefully thereagainst to thereby extend with said forward end portion into the interior of such a building;

(c) said hollow end portion having wall structure with a plurality of openings extending therethrough and bringing the interior thereof into fluid communication with the interior of such a building when the wall or roof of the latter is so pierced by said piercing element and said forward end portion of said pipe section;

(d) a handle member extending outwardly from one side of said hollow pipe;

(e) a tubular connector coupling mounted on said pipe member and connected in fluid communication with the hollow interior of said pipe section, said connector coupling being constructed and arranged to be connected in fluid communication with a charged fire hose to receive water under pressure therefrom;

(f) means connected with said pipe for maintaining said forward end portion within the interior of such a building in wall-piercing position after it has pierced such a wall and extended into the interior of such a building whereby a fire within the interior of the building will be quickly extinguished by a spray of water emanating from the openings of said hollow end portion when pressurized water is admitted into the fire hose when the latter is so connected; and (g) said means comprising a plurality of said openings being directed rearwardly and located rearwardly of the remainder of said openings and being arranged to produce streams of water emanating therethrough in a rearward direction and in non-intersecting relation to all other streams of water emanating from all other of said openings in said wall structure.

20. A fire-fighting tool comprising:

(a) an elongated piercing member having a hollow interior and a hollow forward end portion with a piercing element thereon and being constructed and arranged to pierce the wall or roof of a burning building to thereby extend into the interior thereof;

(b) said forward end portion of said piercing member having wall structure defining its said hollow interior and having a plurality of water disseminating openings extending through said wall structure and bringing the interior of said forward end portion into fluid communication with the interior of such a building when a wall of the latter is so pierced;

(c) means for connecting said hollow interior of said piercing member in fluid communication with a fire hose connected to a source of pressurized water to cause water under pressure to be disseminated through said openings;

(d) means connected with said member for automatically maintaining said member in such wall-piercing position after it has pierced such a wall and extended into the interior of such a building while water under pressure is disseminated through said openings whereby a fire disposed within the interior of the building will be quickly extinguished by water under pressure disseminated through said openings; and (e) said water disseminating openings being circumferentially spaced and disposed and arranged in spaced relation along the length of said forward end portion to produce non-intersecting streams of water, some of said openings being directed rearwardly and being disposed more rearwardly than all others of said openings.

* * * * *